United States Patent [19]

Karliner

[11] 4,390,324

[45] Jun. 28, 1983

[54] PRESSURE RELEASE VALVE FOR PUMPS

[75] Inventor: Rudolf Karliner, Minnetonka, Minn.

[73] Assignee: Wagner Spray Tech Corporation, Minneapolis, Minn.

[21] Appl. No.: 229,168

[22] Filed: Jan. 28, 1981

[51] Int. Cl.[3] ..... F04B 49/06

[52] U.S. Cl. ..... 417/282; 417/305; 417/307; 417/316

[58] Field of Search ..... 417/282, 290, 316, 317, 417/305, 307, 440; 137/495; 251/132, 138

[56] References Cited

U.S. PATENT DOCUMENTS

| | | | |
|---|---|---|---|
| Re. 29,055 | 11/1976 | Wagner | 417/388 |
| 2,145,404 | 1/1939 | Osborne | 417/316 |
| 2,681,177 | 6/1954 | Hartwell | 417/316 X |
| 2,889,779 | 6/1959 | Hofer | 417/305 X |
| 3,147,767 | 9/1964 | Goss | 417/316 X |
| 3,254,845 | 6/1966 | Schlosser et al. . | |
| 3,397,717 | 8/1968 | Tenkku et al. | 251/138 X |
| 3,791,408 | 2/1974 | Saitou et al. | 137/529 |
| 4,022,381 | 5/1977 | Karliner | 417/388 X |

*Primary Examiner*—Leonard E. Smith

*Attorney, Agent, or Firm*—Hill, Van Santen, Steadman, Chiara & Simpson

[57] ABSTRACT

An airless hydraulic diaphragm paint pump having a pumping chamber subdivided by a diaphragm into pumping fluid and pump fluid subchambers with an inlet from a pump fluids storage and an outlet to a pumped fluid utilizer such as a paint spray gun. A bypass port is provided for returning pumped fluid to the source at a low pressure. A pressure release valve in communication with both the outlet and the bypass port is effective to allow bypassing the pumped fluid directly back to the source and to bleed the line between the pumped fluid utilizer and the pump. The valve is actuated by a solenoid actuator and is opened when the pump drive is terminated or manually or in the event of an excessive high pressure.

3 Claims, 2 Drawing Figures

PRESSURE RELEASE VALVE FOR PUMPS

BACKGROUND OF THE INVENTION

1. Field of the Invention

This invention relates to pumps and more particularly to airless paint spray pumps having bypass valves.

2. Prior Art

Diaphragm airless paint spray pumps utilizing a pumping chamber subdivided into a driving fluid chamber and a driven fluid chamber by a diaphragm, with the driving fluid being alternately pressured and relieved by a reciprocating piston are well known to the art. See, for example, U.S. Pat. Nos. 3,254,845 to Schlosser and RE 29,055 to Wagner. Such airless diaphragm pumps have become very popular. A common feature of such pumps is the provision of a bypass valve in the pumped fluid line. The pumped fluid side of the pump includes an inlet having a check valve in it and an outlet having a check valve in it such that flow to and from the pumped fluid subchamber is one way. In order to allow priming of the pump, a low pressure bypass is provided which is valve controlled. With the bypass valve open pumped fluid from the pumped fluid subchamber is released at low pressure usually to a conduit to the supply source.

The bypass valve allows the pump to be primed by providing for relatively pressure free circulation of the pumped fluid through the pumping chamber.

Since each airless diaphragm paint spray pumps frequently operate at pressures between 2,000 and 3,500 PSI, actuation of the bypass valve to allow priming is important. Additionally, however, because of the high pressures involved, when the prime mover is turned off, it would be beneficial to provide a system for allowing the high pressure remaining in the pump and in the line to the pumped fluid utilizer, i.e. the spray gun, to be bled off automatically. One such system has been previously proposed which relies upon an hydraulic system comparing the pressure on the driven fluid side of the diaphragm to the pressure on the driving fluid side of the diaphragm. When the driven fluid pressure substantially exceeds the driving fluid pressure, a bypass is open. See, for example, U.S. Pat. No. 4,022,381 to Karliner. While such a system is effective for bleeding high pressure in the pump after the prime mover has been throttled or turned off, the system does not provide for actuation when the driving fluid is maintained at a relatively high pressure, such as is the case when the motor is full running but a low driven pressure is required for priming.

It would also be desirable to provide an automatic pressure limiter on the driven fluid side. Prior airless diaphragm pumps normally utilize a pressure release valve on the driving fluid side for porting the hydraulic driving fluid from the driving fluid subchamber back to the reservoir. Maximum pressure output of the system is thus controlled by the driving fluid side pressure release valve. However, since such valves can conceivably malfunction, it would be a desired feature to provide such a pressure release on the driven fluid side. Although such high pressure release valves have previously existed in some embodiments, they have not been successfully integrated into commercial diaphragm spray pumps which continue to rely upon the hydraulic side pressure release valve.

It would also be an advantageous contribution to the art of all of the above desired features could be incorporated into a single device which functioned as a combination priming valve, high pressure bleed valve and pressure limiter. It would be further advantageous if the device functioned automatically upon termination of the prime mover and selectively at the operator's desire.

SUMMARY OF THE INVENTION

My presently disclosed construction provides each of the above desired features in a single valve system which, in the preferred embodiment illustrated, is electrically operated by means of a solenoid.

Intermediate the pumped fluid subchamber and the outlet from the pump there is provided both an anti-back flow check valve and a bypass passageway and outlet. The bypass valve is located in the bypass passage and includes a needle valve spring biased to an open position and effective, upon actuation of a solenoid, to close the passageway. The solenoid is wired in series with the prime mover switch and has an additional deactivating switch such that the solenoid is automatically deactivated if the prime mover is turned off thereby automatically opening the passageway downstream of the check valve to bleed pressure both from the line from the pump to the paint utilizer and from the pumped fluid subchamber through the check valve. Additionally, be activating the additional switching the solenoid can be deactivated during operation of the prime mover to provide for a priming state operation.

The solenoid includes a moving plunger which acts against the needle valve through a spring which is compressed by the moving plunger to seat the needle valve. The plunger is adjustable so that by proper setting of the adjustment and of the spring rate of the spring, a maximum closing pressure can be provided for the needle valve. In the event of excessive pumped fluid pressure, the needle valve will be opened to bleed excess pressure. By use of a needle valve having a variable orifice opening, the maximum pressure setting can be relied upon to maintain a pressure at or slightly below the maximum permitted without totally bleeding the line. In this manner the pump can continue to operate effectively moving pumped fluid at a desired pressure.

Although an electrically operated solenoid valve system is shown herein, it is to be understood that other actuators for the needle valve could be provided if desired. For example, the actuator could be pneumatic, hydraulic or an expanding wax actuator.

It is therefore a principal object of this invention to provide an airless diaphragm paint spray pump having improved safety features providing for automatically bleeding line pressure in the event of pump prime mover shut down.

It is another, and more specific object of the invention to provide automatic safety features for airless diaphragm pumps providing automatic release in line pressure in the event of prime mover shut down and providing automatic maximum line pressure control.

It is yet another, and more specific object of this invention to provide a bypass valve system for the pumped fluid side of diaphragm pumps, the bypass valve structure being independently actuatable to provide a bypass priming state allowing recirculation of pumped fluid from and to a source at a low pressure, the bypass being automatically actuated upon shut down of the prime mover to bleed line pressure.

It is yet another specific object of this invention to provide a bypass valve system for diaphragm pumps which is selectively actuatable to provide a low pressure bypass, which is automatically actuated in the event of prime mover shut down to bleed line pressure and which is effective to limit maximum pumped fluid pressure.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
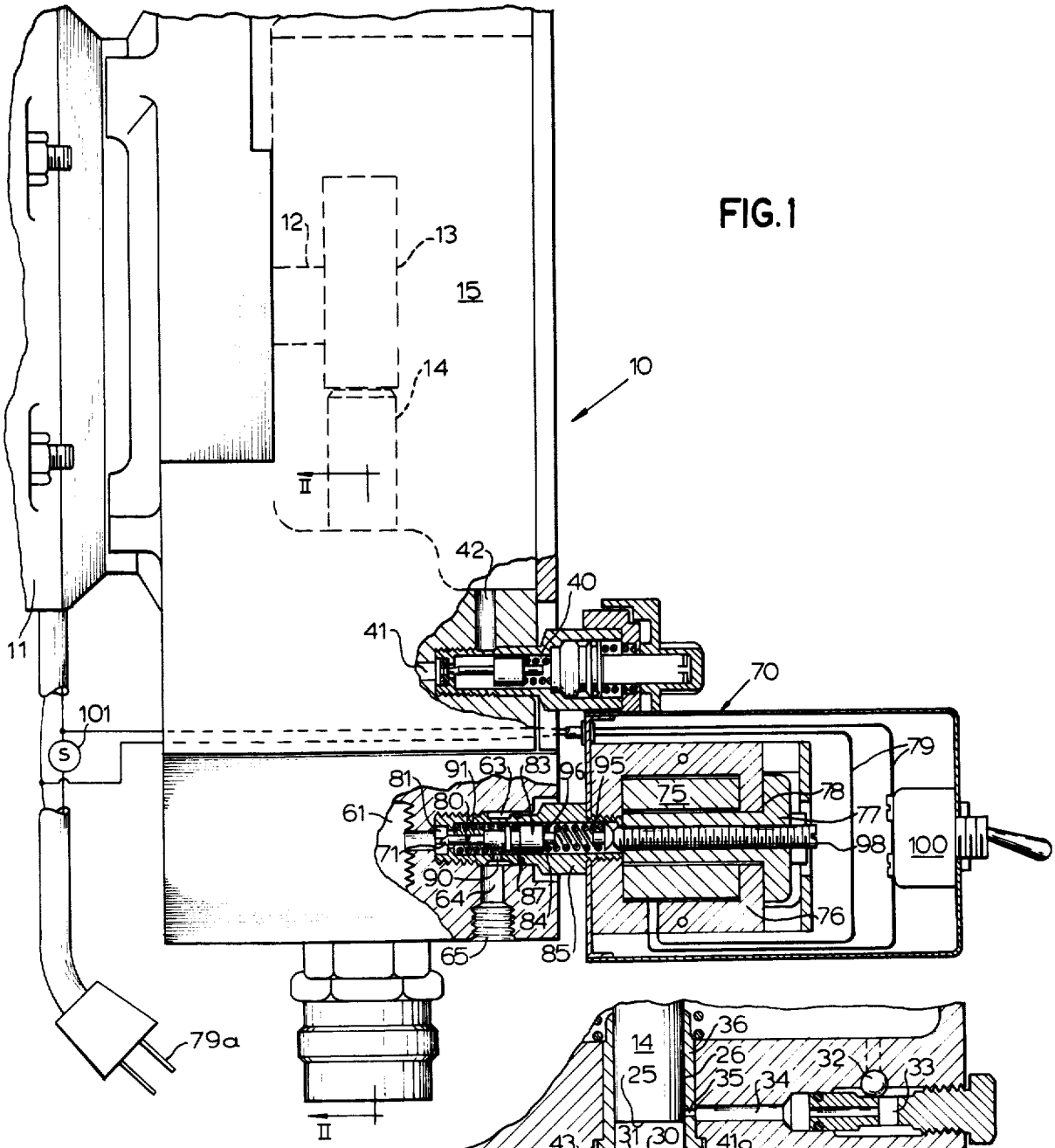
FIG. 1 is a side plan view, partially in section, of an airless diaphragm paint pump equipped with the bypass valve of this invention.
Figure 2:
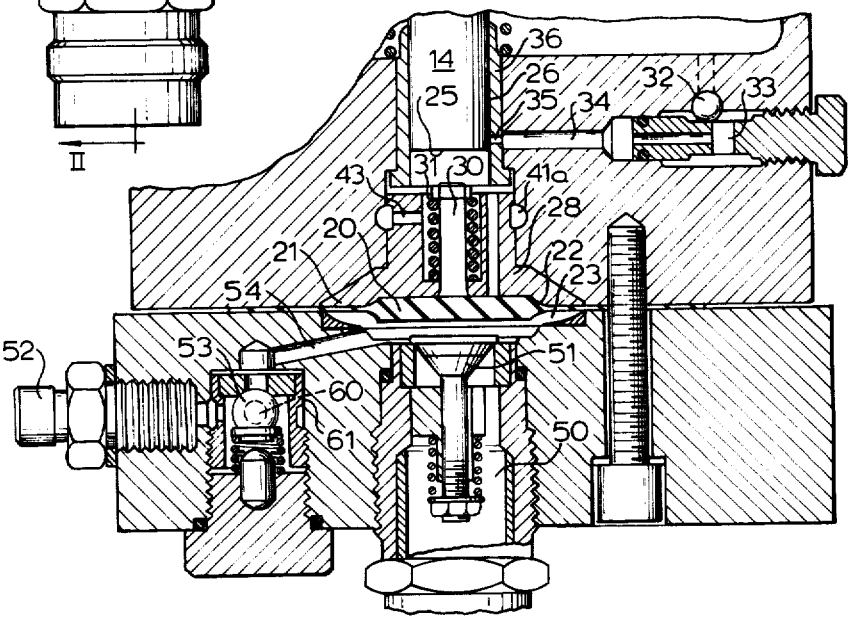
FIG. 2 is a fragmentary sectional view of the pump of FIG. 1.

FIG. 1 illustrates the pumping section 10 of a diaphragm pump particularly of the type used in airless paint spraying. The pump includes a prime mover 11 such as an electric motor which rotates a shaft 12 coupled to an eccentric mount bearing 13. Rotation of the bearing 13 reciprocates a piston 14. The bearing and upper end of the piston are received in a chamber 15 which functions as a driving fluid reservoir, the driving fluid normally being an hydraulic oil or the like. As best shown in FIG. 2, a diaphragm 20 subdivides a diaphragm chamber 21 into a pumping fluid side 22 and a pumped fluid side 23. The bottom 25 of the piston, received in a cylinder 26 is open to the pumping fluid subchamber. In the embodiment illustrated the bottom of the piston is open to the subchamber through a fitted insert 28 which defines the configuration of the diaphragm chamber. The diaphragm may, for example, be of the type having an axial shank projection 30 which cooperates with a spring 31 to draw the diaphragm to a fully seated position on the face of the insert 28 defining the bottom of the diaphragm chamber on the driving fluid side. Hydraulic oil from the reservoir 15 flows through a passageway 32, then through a flow restricter 33 which may include a filter to a passageway 34. Passageway 34 in turn is open to passageways 35 in the cylinder 36 in which the piston rides. The passageways 35 are located at a point where they will be opened to the interior of the cylinder at the top dead center of the stroke of the piston and the passageways 35 therefore cooperate with the piston 14 to form a slot valve allowing hydraulic oil from the reservoir to be sucked into the hydraulic side of the pumping mechanism whenever the pressure of the hydraulic oil in the pumping side of the diaphragm chamber is less than the pressure in the reservoir and the slot valve is open. Upon the forestroke of the piston the slot valve 35 will be closed and the hydraulic oil on the driving side will be pressured causing the diaphragm 20 to move downwardly in the position shown in FIG. 2. On the upstroke of the piston the diaphragm will move upwardly. The result of this is that the paint subchamber 23 will increase and decrease in size in relationship to the movement of the piston, the hydraulic oil in the driving fluid side acting as an hydraulic column transferring movement of the piston to movement of the diaphragm.

An adjustable pressure relief valve 40 is provided controlling flow from channel 41 open to ring **41*a* to channel 42 open to the reservoir. Ring 41*a* is open to the driving fluid chamber 22 through passageway 43 in the insert 28. Thus, when the pressure in the hydraulic fluid on the driving side exceeds the setting of the adjustable pressure valve 40, hydraulic oil will flow from the driving side of the diaphragm through conduit 43, ring 41*a*, conduit 41 and conduit 42** back to the reservoir. In this manner, maximum pressure on the hydraulic column can be controlled.

The paint side of the pump includes an inlet 50 containing a poppet valve 51 through which the inlet communicates to the pumped fluid subchamber 23 of the diaphragm chamber. An outlet 52 communicates through a check valve 53 to a conduit 54 which is also in communication with the pumped fluid subchamber 23.

In operation, as the piston 14 is moved upwardly or away from the diaphragm chamber, the diaphragm will be drawn upwardly. This increases the area of the pumped fluid subchamber 23 resulting in a suction condition which opens poppet valve 51 and causes a flow of pumped fluid into the subchamber 23. Upon the downstroke of the piston, the hydraulic column causes the diaphragm 20 to move downwardly. The increase in pressure in the pumped fluid chamber 23 closes poppet valve 51 and opens check valve 53 causing a flow through the outlet 52.

In accordance with this invention, a bypass conduit or port is provided having a passageway 60 shown in FIG. 1 open to the bore 61 of the check valve. Passageway 60 opens to bore 63 which in turn is opened to passageway 64 having outlet 65. The outlet 65 can be connected to conduit back to the supply source to the inlet 50. A bypass valve indicated generally at 70 and including needle valve 71 controls communication of passageway 60 and passageway 64. In the embodiment illustrated, the bypass valve is a solenoid operated valve including a coil 75 received in coil holder 76 and effective, when energized, to operate plunger 77. The coil is in electrical connection via circuitry 79 to a power source **79*a* which is used to power the prime mover 11. In this manner when the prime mover 11 is turned on, the coil 75 is normally energized. With the coil energized, the plunger 77 is drawn into the coil, or towards the left as shown in FIG. 1, until the plunger shoulder 78 abuts the end of the coil frame 76. Needle valve 71 includes a needle 80 received in a seat 81 and attached to an enlarged diameter needle plunger 83 received in the bore 84 of the needle valve housing 85 which is threaded into the bore communicating passageway 61 and 64. By means of an O-ring seal or the like 87 it is assured that no fluid will flow past the opening 90 in the needle valve housing to the passageway 64. A spring 91 between the seat 81 and an enlarged shoulder on the needle plunger urges the needle into an open position out of engagement with the seat 81. A second spring 95 between an opposed shoulder 96 and an adjustable screw 98 of the solenoid plunger 77 is used to transmit the force of the solenoid plunger 77 to the needle plunger 83 to bring the needle tip 71 into engagement with the seat 81. By use of an adjustable screw 98 in the solenoid plunger 77, together with a spring 95, the bypass needle valve can be factory adjusted to have a maximum closure pressure of the needle against the seat such that the existence of any pressure greater than that at the seat will cause the needle valve to be opened. By utilizing a needle valve or other variable orifice valve, the amount of flow through the bypass valve can be varied in relationship to the degree that the needle has been opened thereby providing a "floating" pressure control for the pump fluid outlet. In this manner, should the pump fluid outlet pressure exceed a factory predetermined maximum, the needle valve will be caused to open irrespective of the fact that the solenoid plunger 77 is in its fully activated position. This will allow a portion of the pumped fluid to be bypassed to the bypass outlet 65 resulting in a decrease in pressure in the pumped fluid outlet. This provides a safety feature for pumps, particularly high pressure pumps, where an extremely high pressure could either cause the motor to stall out or burn out, or could cause rupture of some of the downstream components such as the pressure hose or pump fluid utilizer. Thus, by utilizing the bypass valve of this invention, should the main pressure limiter, the adjustable pressure valve 40, fail, the bypass valve provides a secondary pressure limiter. The factory preset pressure can be easily adjusted by rotation of the screw 98** so as to be compatible either with motor capability, desired maximum pressure at the paint utilizer, or to provide a safety margin with respect to the pressure containment capabilities of the components downstream of the pump.

Additionally, I have provided a switch 100 which is capable of de-energizing the coil 75 even when the prime mover 11 is energized. This allows the bypass valve to be opened to provide for start up priming of the system at a low pressure. It also allows the line pressure to be selectively dumped at any time without turning off the prime mover. By placing the switch 100 in series with the switch 101 controlling the motor 11, the coil 75 will be de-energized whenever the motor is off or when the motor is on and switch 100 off. Of course, the power to the coil should also be interrupted if the overload protector of the motor actuates.

Of course, it will be appreciated that since the circuitry for energization of the coil is tied to the circuitry for energization of the prime mover, as soon as the motor is turned off the line pressure from the outlet will be dumped via the bypass. In the construction shown, since the conduit 60 to the bypass is open downstream of the check valve seat, as long as there is any pressure in the pumped fluid subchamber 23 greater than the closure pressure of the check valve 53, that pressure will also be dumped through the bypass needle valve. Due to the pressure limiting function of the spring 95, should blockage occur in the conduit downstram allowing pressure to rise in the system to greater than the desired maximum, the bypass valve will open automatically before damage can occur to the diaphragm.

It should be appreciated that although I have shown herein a needle valve operated by an electronic solenoid, other systems could be used including other types of pressure valving, such as, for example, spool valves, poppet valves, etc. In addition, other types of actuators other than the solenoid could be used. For example, the valve can be actuated by hydraulic or pneumatic pressure or by other types of controllable actuators.

It will therefore be appreciated from the above that this invention provides a bypass valve for high pressure pumps which allows pressure in an outlet line to be bled at a low pressure by opening a valve controlling a bypass conduit. The valve is a normally open valve maintained in a closed condition by a valve actuator. Means are provided to override the valve actuator to open the valve in the event of an excessive high pressure at the valve seat. Additionally, means are provided to deactivate the valve actuator in the event of shut-off of the pump prime mover or selectively whenever it is desired to leave the bypass passageway open such as, for example, when priming the pump. In the embodiment illustrated, the needle valve is a normally opened valve due to the presence of spring 91. The valve is a maximum pressure valve due to the presence of the spring 95. It is to be understood that other types of devices may be utilized to provide the functions of these springs. Also, it is possible to utilize a normally closed valve and to utilize the valve actuator to open the valve.

Although the teachings of my invention have herein been discussed with reference to specific theories and embodiments, it is to be understood that these are by way of illustration only and that others may wish to utilize my invention in different designs or applications.

I claim as my invention:

1. A hydraulic column diaphragm pump comprising a housing containing a pumping chamber, a diaphragm dividing said chamber into a driving fluid chamber and a driven fluid chamber, a hydraulic fluid reservoir in said housing, means communicating the reservoir to the driving fluid chamber, means for loading and unloading the hydraulic fluid in the driving fluid chamber to reciprocate the diaphragm, pressure release means communicating the driving fluid chamber to the reservoir affective to release excess pressure in the driving fluid chamber by establishing communication between the driving fluid chamber and reservoir, said pressure release means being adjustable, an inlet to said driven fluid chamber, an outlet from said driven fluid chamber, said outlet from said driven fluid chamber including first passage means from said driven fluid chamber to a bore means, a second passage from said bore means to an outlet fitting, and a check valve in said bore means movable from a closed position blocking communication between said first and said second passages and an open position establishing communication between said first passage and said second passage, said check valve being normally biased to the closed position and being operable from the closed position to the open position upon the establishment of a condition in which pressure in the first passage is greater than pressure in the second passage, a third passage open to said bore means downstream of said check valve, said third passage open to second bore means through a variable orifice valve interpositioned between said third passage and said second bore means, a bypass conduit open to said second bore means downstream of said variable orifice valve, a valve actuator for said variable orifice valve, said valve actuator including a first movable member movable towards and away from a seat of said variable orifice valve, spring means urging said first movable member away from said seat, a solenoid having a second movable member, spring means interposed between said first movable member and said second movable member, urging said first movable member towards said seat, activation of said solenoid effective to move said second movable member toward said first movable member and to compress said second spring, compression of said second spring effective to overcome said first spring and cause said first movable member to block communication between said third passage and said second bore means at said seat with a closure force, said second movable member being position adjustable whereby the degree of compression of the second spring when said solenoid is actuated, is adjustable by adjustment of the position of the second movable member, adjustment of the compression of the second spring effective to control said closure force, said third passage and said bypass conduit in communication through said second bore means when said variable orifice valve is open, motor means for driving said means for loading and unloading, circuit means for activating said motor means, second circuit means for activating said solenoid, said first circuit means and said second circuit means being interconnected whereby deactivation of said first circuit means deactivates said second circuit means, switch means for selectively deactivating said second circuit means independent of deactivation of said first circuit means, deactivation of said second circuit means causing movement of said second movable member away from said first movable member to a point where said first spring overcomes said second spring and opens said variable orifice valve, and said variable orifice valve being openable when said solenoid is activated by the presence of a pressure in said third passage acting against said first movable member at said seat which, combined with the force of said first spring overcomes said closure force.

2. The device of claim 1, wherein the variable orifice valve is a needle valve, the said first movable member includes a needle receivable in said seat.

3. The device of claim 2, wherein a cylinder member is received in said second bore means, the cylinder member having said seat at its inboard end, said third passage being adjacent the inboard end of the cylinder member, said cylinder member having a hollow interior, a fourth passage communicating the hollow interior to said bypass conduit, said first movable member positioned in said hollow interior, said needle movable towards and away from said inboard end into seating engagement with said seat, a flange area on said first movable member spaced from a tip of said needle, said first spring positioned between said inboard end and said flange effective to bias said first movable member away from said inboard end, said second spring at least partially received in said hollow interior, said second spring bottoming against said flange on a side opposite the first spring and said second movable member axially aligned with said first movable member.

* * * * *